US005668784A

United States Patent [19]

Iguchi

[11] Patent Number: 5,668,784

[45] Date of Patent: Sep. 16, 1997

[54] WATCH BAND ATTACHMENT MECHANISM

[75] Inventor: Hajime Iguchi, Fuchu, Japan

[73] Assignee: Casio Computer Co., Ltd., Tokyo, Japan

[21] Appl. No.: 611,243

[22] Filed: Mar. 5, 1996

[30] Foreign Application Priority Data

Mar. 7, 1995 [JP] Japan ..... 7-047417

[51] Int. Cl.[6] ..... G04B 37/00

[52] U.S. Cl. ..... 368/282; 224/164

[58] Field of Search ..... 368/281, 282; 224/168, 169, 164, 167, 170, 171, 173, 180

[56] References Cited

U.S. PATENT DOCUMENTS

| | | | |
|---|---|---|---|
| 1,760,689 | 5/1930 | Domler | 368/282 |
| 1,849,482 | 3/1932 | Dike | 368/282 |
| 4,639,144 | 1/1987 | Chau | 368/276 |

*Primary Examiner*—Bernard Roskoski

*Attorney, Agent, or Firm*—Frishauf, Holtz, Goodman, Langer & Chick

[57] ABSTRACT

A pair of band holding members are attached by joint pins to band attachment portions of a watch case formed at positions of 12 o'clock and 6 o'clock of a dial in the watch case. The band holding members extend obliquely and outwardly from a back surface of the watch case in a direction opposite to a front surface thereof. A watch band insertion slot is formed in each of the holding members to extend from a first position which is positioned at or away from the back surface of the watch case to a second deposition which is positioned further away from the back surface of the watch case than the first positions and to open at the first and second positions. A watch band consisting of one band piece is passed through the watch band insertion slots of the band holding members so that the watch band projects its both end portions from the openings of the second positions of the insertion slots of the band holding members toward outsides of the holding members and extends along the back surface of the watch case.

7 Claims, 7 Drawing Sheets

WATCH BAND ATTACHMENT MECHANISM

BACKGROUND OF THE INVENTION

1. Field of the Invention

This invention relates to a watch band attachment mechanism for attaching a watch band to a case of a wrist watch.

2. Description of the Related Art

Conventional wrist watches are usually provided with a pair of band attachment portions formed on an outer peripheral surface of the watch case at positions of, for example, 12 o'clock and 6 o'clock of a dial. Each of the band attachment portions includes a pair of supporting projections projecting from the outer peripheral surface of the watch case and a spring rod both ends of which are supported by the supporting projections.

If the watch band consists of a pair of band pieces, base end portions of the band pieces are attached to the band attachment portions by passing the spring rods of the band attachment portions through connecting holes of the base end portions of the band pieces. If the watch band consists of one band piece at both ends of which connecting holes are formed, the both ends of one band piece are attached to the band attachment portions by passing the spring rods of the band attachment portions through the connecting holes of the both ends of one band piece. There is a case that a watch band consisting of one band piece the both ends of which have no connecting hole is attached to the pair of band attachment portions. When such a one band piece is attached to the pair of band attachment portions of the conventional wrist watch, the one band piece is inserted into a gap between the spring rod of one of the band attachment portions and the outer peripheral surface of the watch case from a front side to a back side of the wrist watch with one end portion of the band piece being positioned at a leading side. Then, the one band piece is pulled along a back surface of the watch case until the one end portion of the one band piece reaches the other band attachment portion, and the one band piece is inserted into a gap between the spring rod of the other band attachment portion and the outer peripheral surface of the watch case from the back side to the front side of the watch case. Thus, the one band piece attached as described above to the pair of band attachment portions of the watch case extends a middle portion thereof along the back surface of the watch case and projects the both end portions thereof to the front side from the back side of the watch case through the band attachment portions.

Therefore, when the watch band consisting of one band piece having no connecting holes at its both ends is attached to the pair of band attachment portions of the above described conventional wrist watch, the one end portion of the one band piece must be inserted firstly into one of the band attachment portions from the front side to the back side of the watch case, and, then, it must be inserted into the other band attachment portion from the back side to the front side of the watch case. Therefore, the band attachment operation is troublesome. Likewise, a band detachment operation is also troublesome.

Additionally, when the watch band consisting of one band piece having no connecting holes at the both ends thereof is attached to the pair of band attachment portions of the above described conventional wrist watch and the both end portions of the one band piece are wrapped around a wrist of a user using the wrist watch and are fastened together, the both end portions of the one band piece can not fit on the user's wrist at positions near around the pair of the band attachment portions and the fitness of the both end portions of the one band piece to the user's wrist is not so good because the both end portions of the one band piece are projected from the back side of the watch case to the front side through the pair of band attachment portions.

Finally, by the above described conventional watch band attachment mechanism, the spring rods of the paired band attachment portions of the wrist watch are subjected to a load directed from the front side toward the back side of the watch case when the both end portions of the one band piece is wrapped around the user's wrist and are fastened together. In this condition, one or both of the spring rods is or are rarely released from the corresponding supporting projections and consequently the watch case is disengaged from the watch band and falls down on a floor or a road.

SUMMARY OF THE INVENTION

In view of the above circumstances, the object of the present invention is to provide a band attachment mechanism by which the band attaching and detaching operations of the watch band, the watch band consisting of the one band piece having no connecting holes at the both ends thereof, to the pair of band attachment portions of the wrist watch becomes easy, possibility of detaching of the watch band from the paired band attachment portions becomes actually zero, and fitness of the watch band on the user's wrist is improved.

In order to achieve the above object, a watch band attachment mechanism according to the present invention, comprising: a watch case provided with a pair of band attachment portions on an outer peripheral surface thereof; and a pair of band holding members detachably attached to the band attachment portions, each extending from a back surface of the watch case in a direction opposite to a front surface of the watch case, and each having a watch band insertion slot extending from a first position which is positioned at or away from the back surface of the watch case in the opposite direction, to a second position which is positioned further away from the back surface of the watch case in the opposite direction than the first position, the watch band insertion slot opened at the first and second positions, wherein both end portions of a watch band consisting of one band piece are inserted into the band insertion slots of the band holding members to project the both end portions from the openings of the second positions of the watch band insertion slots of the band holding members toward out sides of the band holding members and to extend along the back surface of the watch case between the openings of the first positions of the watch band insertion slots of the band holding members while the band holding members are detachably attached to the band attachment portions of the watch case.

With the above described arrangement, since the opening of the first position of the watch band insertion slot of each of the pair of band holding members is positioned at or away from the back surface of the watch case in a direction opposite to the front surface of the watch case, and the opening of the second position of the watch band insertion slot of each of the band holding members is positioned further away from the back surface of the watch case in the opposite direction than the first opening, the both end portions of the watch band are lead by the corresponding watch band insertion slots to be extended from the fist openings to the second openings respectively. Thus, the whole of the both end portions of the watch band can fit intimately on the user's wrist even at the pair of the band attachment portions when the both end portions of the watch band are wrapped around the user's wrist and are fixed together.

Additionally, if each of the band attachment portions on the outer peripheral surface of the watch case is structured as the above described conventional one, the load applied to each of the spring rods of the band attachment portions of the wrist watch by the both end portions of the one band piece of the watch band and directed from the front side toward the back side of the watch case when the both end portions of the one band piece are wrapped around the user's wrist and are fixed together, is reduced by the band holding members so that the possibility of accidental detaching of one or both of the spring rods from the corresponding supporting projections becomes actually zero and consequently disengagement of the watch case from the watch band to allow the wrist watch to fall down on the floor or the road also actually becomes zero.

Finally, if each of the band attachment portions on the outer peripheral surface of the watch case is structured as the above described conventional one, the band holding members can be attached on and detached from the corresponding band attachment portions easily by the spring rods. And, since each of the watch band insertion slots of the band holding members extends from the first portion to the second position, the both end portions of the watch band can be inserted into the corresponding band insertion slots easily, the watch band consisting of one band piece. Therefore, the attachment and detachment operations of the watch band of the one band piece on and from the pair of the band attachment portions of the watch case can be performed easily.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS (First Embodiment)

Figure 1:
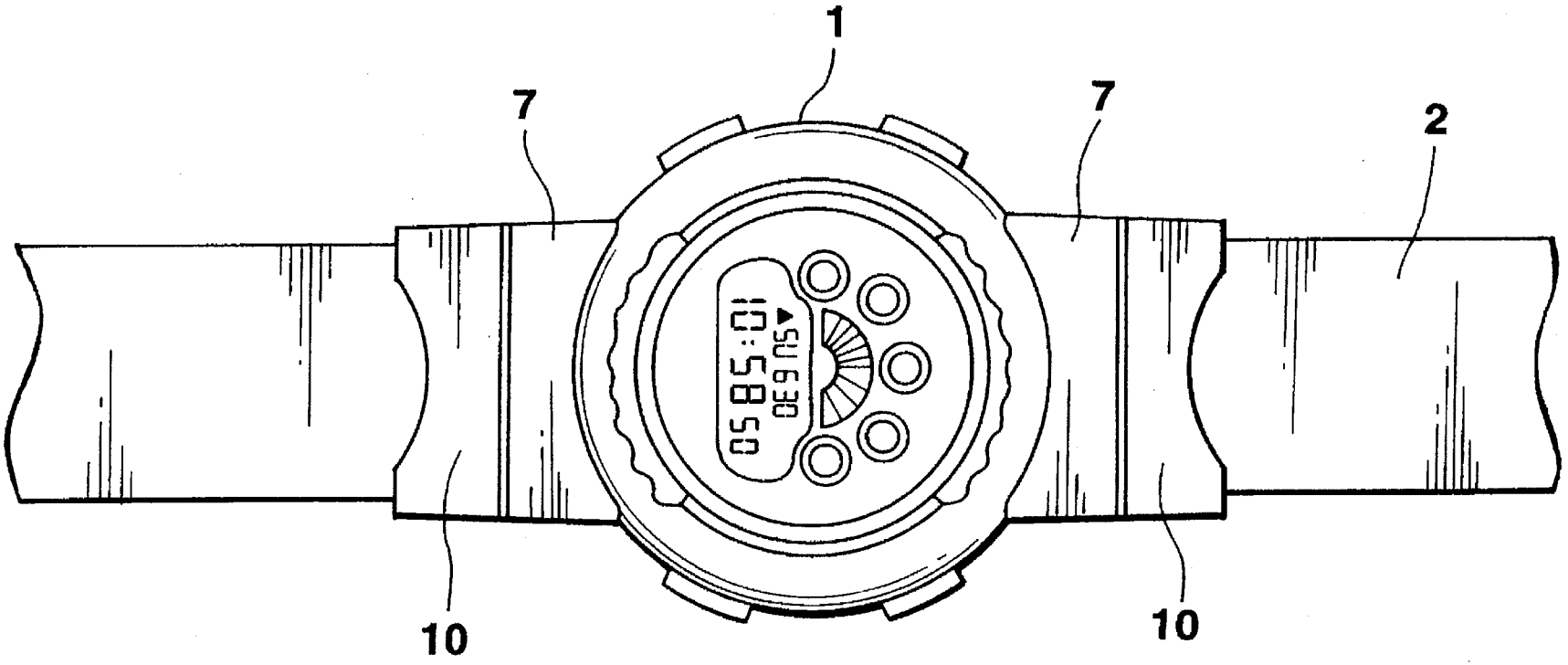
FIG. 1 is a plan view showing a wrist watch provided with a first embodiment of a band attachment mechanism according to the invention and a watch band consisting of one band piece and attached on the wrist watch by the band attachment mechanism.
Figure 2:
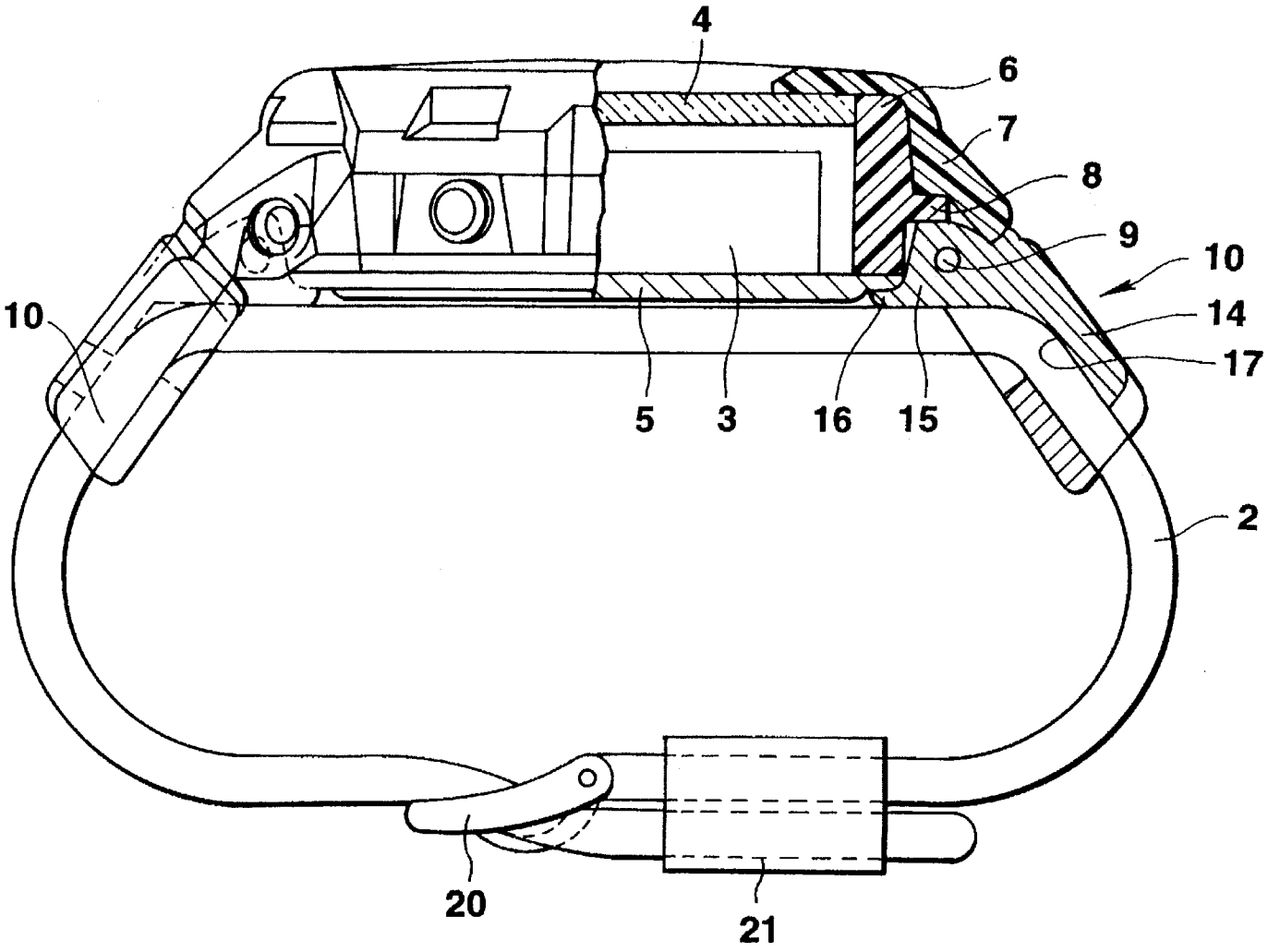
FIG. 2 is a side view of the wrist watch provided with the first embodiment of the band attachment mechanism of FIG. 1, a main portion of the wrist watch being cut-away.

FIGS. 1 through 5 show a first embodiment of the invention. Referring to FIG. 1, the first embodiment comprises a watch case 1 of a wrist watch being provided with a pair of band attachment portions on an outer peripheral surface of the watch case, a pair of band holding members 10 detachably attached to the band attachment portions of the watch case 1 and a watch band 2 of one band piece detachably held by the band holding members 10. As shown in FIG. 2, the watch case 1 houses a watch module 3, a front side thereof is provided with a watch glass 4 and a back side thereof is provided with a back cover 5. The watch case 1 is structured by a resin-made inner case 6 and a resin-made outer case 7 covering the inner case 6. In this embodiment, the inner case 6 is formed of a hard resin material such as ABS and the outer case 7 is formed of a soft resin material such as urethane resin. The outer case 7 formed of a soft resin material can absorb any external impact applied to the watch case 1 to protect the watch module 3 from the impact.

Figure 4:
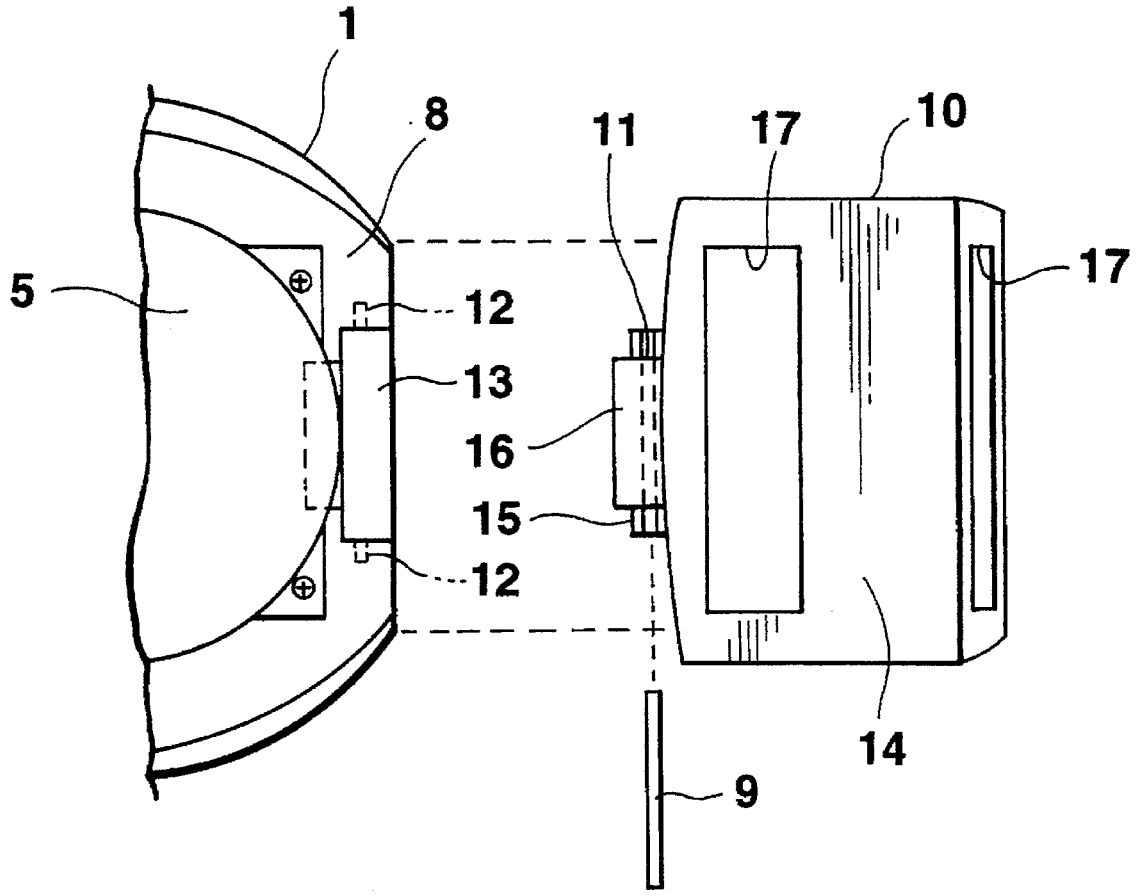
FIG. 4 is a bottom view showing one of the band holding members of the first embodiment of the band attachment mechanism of FIG. 1 and one of band attachment portions of the wrist watch to which the band holding member is to be attached.

The pair of band attachment portions 8 are arranged on the watch case 1 at positions of 12 o'clock and 6 o'clock of a dial in the watch case 1. As shown in FIG. 4, a recess 13 is formed at each of the band attachment portions 8 in an edge of the back surface of the watch case 1, and each of a pair of band holding members 10 is engaged in and fixed to the recess 13 of the corresponding one of the band attachment portions 8. The fixation of the band holding member 10 to the recess 13 of the corresponding one of the band attachment portions 8 by a joint pin 9 provided with a spring (See FIG. 2). For the fixation, a pin hole 11 through which the joint pin 9 is to be passed is formed in a base end portion of the corresponding band holding member 10, and a pair of connecting holes 12 for receiving the both ends of the corresponding joint pin 9 are formed at both sides of the recess 13 of each of the band attachment portions 8.

Figure 3:
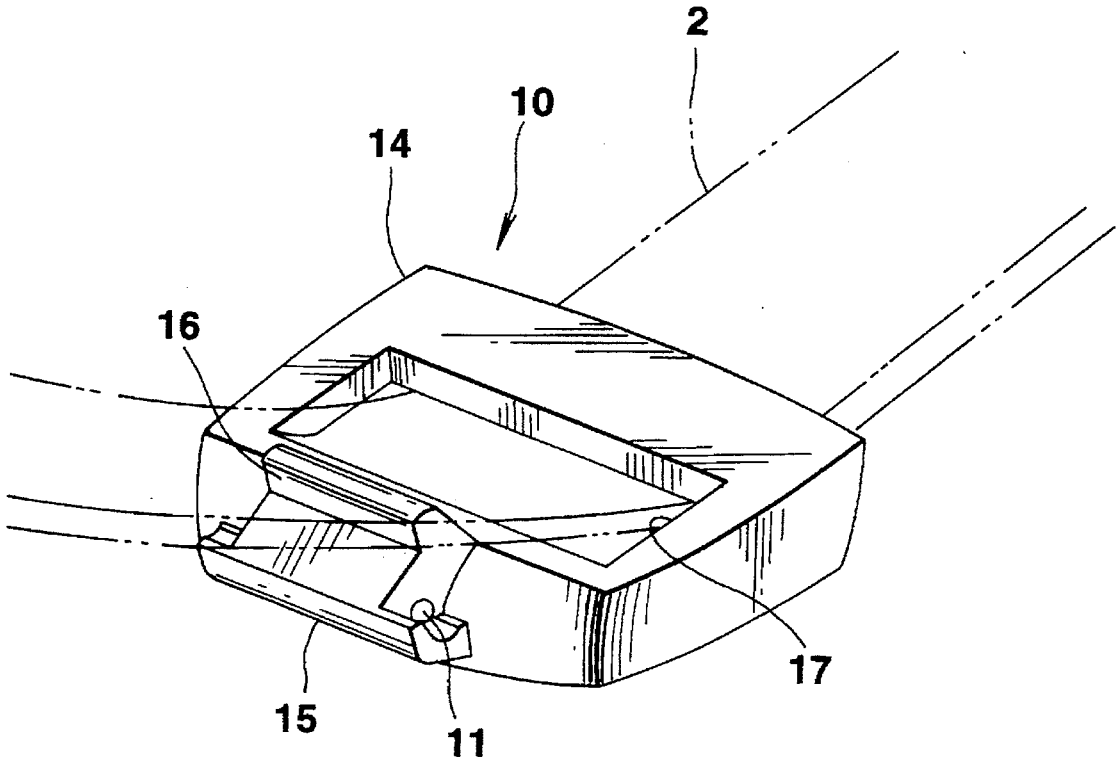
FIG. 3 is a perspective view showing a back surface of one of band holding members of the first embodiment of the band attachment mechanism of FIG. 1.

FIGS. 3 and 4 shows a back surface of the band holding member 10. The band holding member 10 includes a main body 14 and an engaging portion 15 integrally formed at a base end of the main body 14. The engaging portion 15 has an abutting tab 16 designed to abut an edge of the back cover 5 of the watch case 1 as shown in FIG. 2 and a pin hole 11 for receiving the corresponding joint pin 9. The engaging portion 15 is engaged in the corresponding recess 13 of the watch case 1 and is fixed to the corresponding band attachment portion 8 of the watch case 1 by the Joint pin 9.

Since the abutting tab 16 abuts the edge of the back surface of the back cover 5 of the watch case 1, the corresponding band holding member 10 is prevented from freely rotating relative to the watch case i and, thus, it is supported to extend in an obliquely and outwardly from the back surface of the watch case 1 in a direction opposite to the front surface thereof.

Since whole of the band holding member 10 extends obliquely and outwardly from the back surface of the watch case 1 in the above described direction, the back surfaces of the band holding members 10, together with that of the watch case 1, intimately fit on a user's wrist so that fitness of the wrist watch to the user's wrist is improved.

A band insertion slot 17 through which the watch band 2 is passed is formed in the main body 14. The band insertion slot 17 extends along the extending direction of the main body 14 from a first position which is positioned at or away from the back surface of the watch case 1 in the opposite direction to a second position which is positioned further away from the back surface in the opposite direction than the first position, and is opened at the first and second positions. To attach the watch band 2 consisting of one band piece and having no connecting hole at both ends thereof to the pair of band attachment portions 8 of the watch case 1, one end of the watch band 2 is inserted firstly into the second or outer opening of the watch band insertion slot 17 of one of the band holding members 10 so that the one end of the watch band 2 is guided at the first or inner opening of the watch band insertion slot 17 by the abutting tab 16 to move along the back surface of the watch case 1 and the one end of the watch band 2 can be introduced easily into the first or inner opening of the watch band insertion slot 17 of the other band holding member 10 to be passed therethrough. With such a structure, when the both end portions of the watch band 2 is wrapped on the user's wrist, the watch band 2 will not apply a large load to the joint pins 9 to detach the joint pins 9 easily and accidentally from the corresponding band attachment portions 8 and then to detach the watch case 1 from the watch band 2. Additionally, the attachment and detachment of the watch band 2 to and from the pair of the band holding members 10, that is of the band attachment portions 8 of the watch case 1, can be easily performed, and the watch band 2, together with the back surfaces of the watch case 1 and the band holding members 10, can be fitted intimately on the user's wrist.

In this embodiment, the band holding members 10 are formed entirely of a soft resin material such as urethane resin so that the band holding members 10 can absorb any external impact applied to the watch case 1. The band holding members 10 and the watch band 2 can be colored in any colors to improve an appearance of the wrist watch.

The both ends of the watch band 2 are provided with detachable fixing means, and, as shown in FIG. 2, in this embodiment a buckle 20 and a band keeper 21 attached at one end of the watch band 2 and punch holes formed at the other end are the fixing means.

Figure 5:
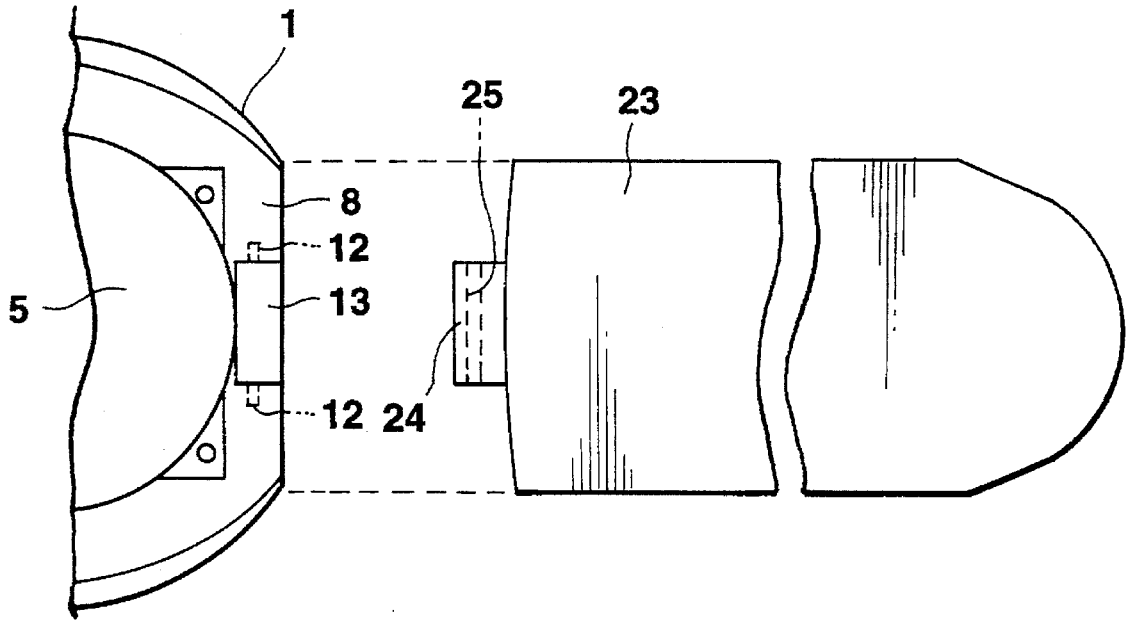
FIG. 5 is a bottom view showing one of the band attachment portions of the watch case of FIG. 4 and one of a pair of band pieces as a watch band which is to be attached to the corresponding one of the band attachment portions without using the band holding members of the first embodiment of the band attachment mechanism.

FIG. 5 is a bottom view showing one of the band attachment portions 8 of the watch case 1 of FIG. 4 and one of a pair of band pieces 23 as a watch band which is to be attached to the corresponding one of the band attachment portions 8 without using the band holding members 10 of the first embodiment of the band attachment mechanism. The band pieces 23 are well known, a connecting tab 24 is formed at a base end of each of the band pieces 23, and a pin hole 25 is formed in the connecting tab 24. In order to attach the conventional watch band to the band attachment portions 8 of the watch case 1, the connecting tab 24 is engaged in the recess 13 of the corresponding band attachment portions 8 with the joint pin 9 (see FIG. 4) being received in the pin hole 25, and then the both ends of the join pin 9 are inserted into the pair of the connecting holes 12 of the corresponding recess 13. With this embodiment, the watch band 2 consisting of one band piece shown in FIG. 2 and the watch band 2 consisting of the pair of band pieces shown in FIG. 5 can be used in accordance with user's choice.

(Second Embodiment)

Figure 6:
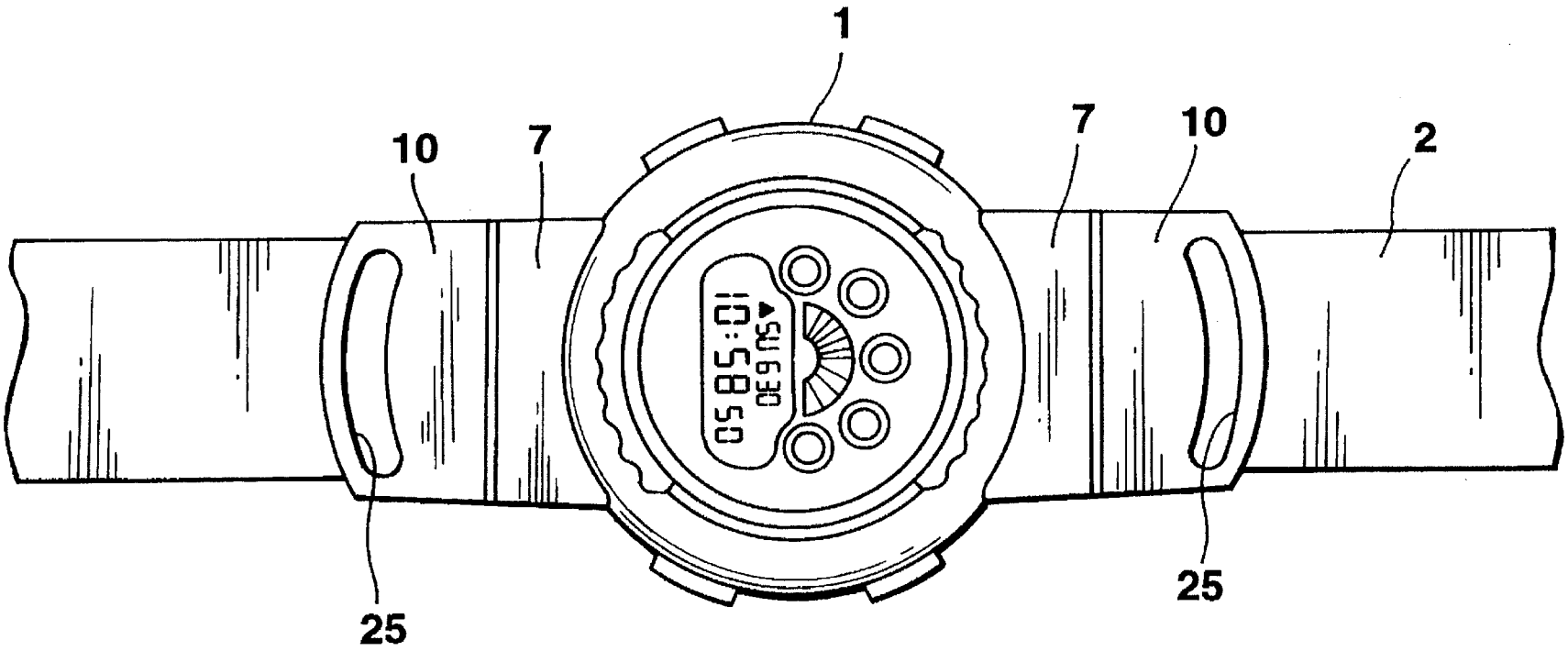
FIG. 6 is a plan view showing a wrist watch provided with a second embodiment of the band attachment mechanism according to the invention and a watch band consisting of one band piece and attached on the wrist watch by the band attachment mechanism.
Figure 7:
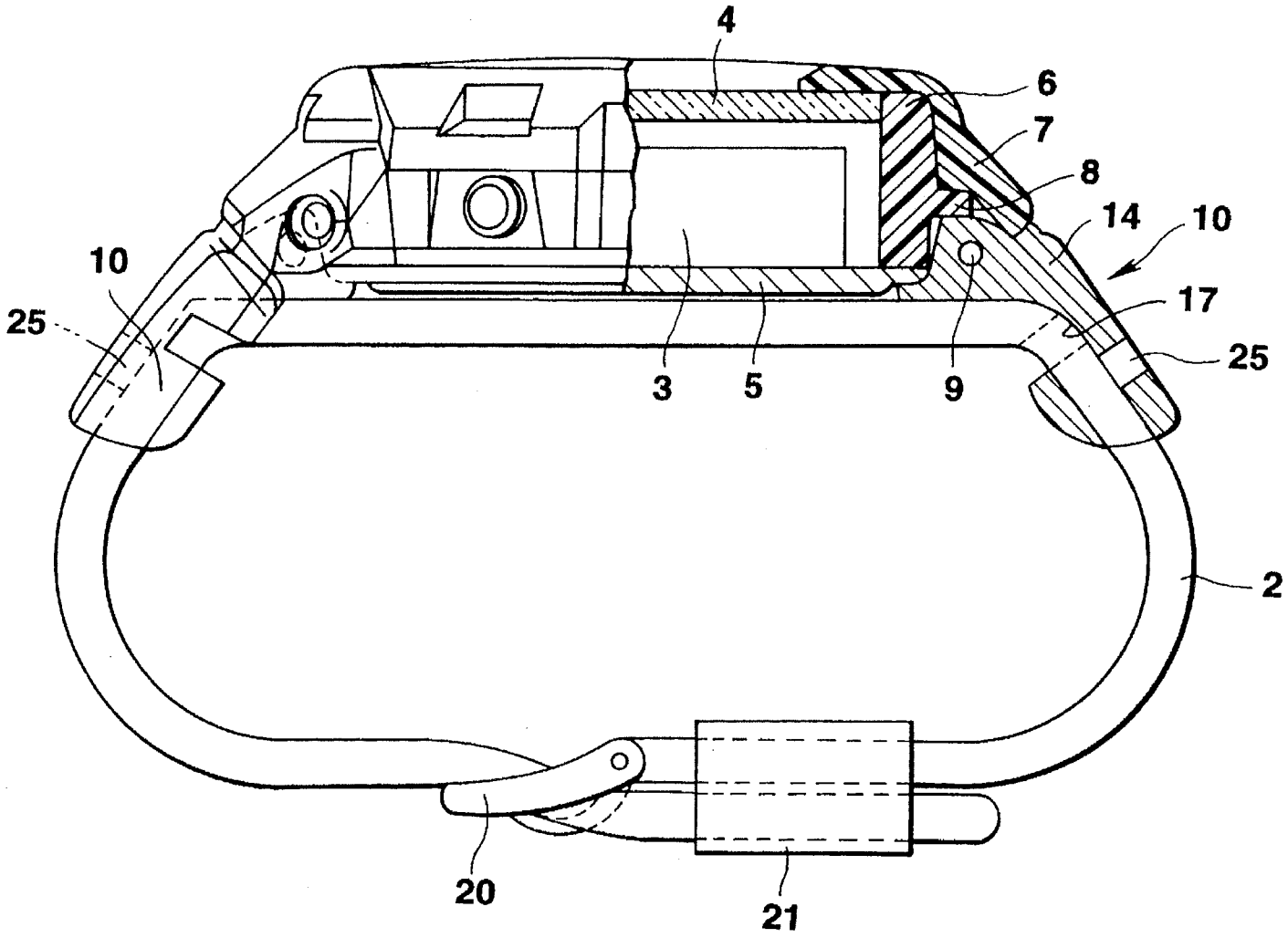
FIG. 7 is a side view of the wrist watch provided with the second embodiment of the band attachment mechanism of FIG. 6, a main portion of the wrist watch being cut-away.

FIGS. 6 and 7 show a second embodiment of the band attachment mechanism of the invention. In FIGS. 6 and 7, structural elements of the second embodiment that are the same or similar to those of the first embodiment are denoted by the same reference numerals as those denoting the same or similar structural elements of the first embodiment, and detailed descriptions for them are omitted. In this embodiment, a slit 25 is formed in a front wall of the main body 14 of each of the band holding members 10 at a position near to the extending end thereof. The slit 25 provides a further flexibility to the band holding member 10 so that it may be further curved along the user's wrist to improve the fitness of the band holding member 10, or the watch band, to the user's wrist. Additionally, the slit 25 provides variable design to the watch band, or the wrist watch.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A band attachment mechanism comprising:

a watch case provided with a pair of band attachment portions on an outer peripheral surface thereof; and a pair of band holding members detachably attached to the band attachment portions, each extending from a back surface of the watch case in a direction opposite to a front surface of the watch case, and each having a watch band insertion slot extending from a first position which is positioned at or away from the back surface of the watch case in the opposite direction, to a second position which is positioned further away from the back surface of the watch case in the opposite direction than the first position, the band insertion slot opened at the first and second positions, wherein both end portions of a watch band consisting of one band piece are inserted into the band insertion slots of the band holding members to project the both end portions from the openings of the second positions of the watch band insertion slots of the band holding members toward outsides of the band holding members and to extend along the back surface of the watch case between the openings of the first positions of the watch band insertion slots of the band holding embers while the band holding members are detachably attached to the band attachment portions of the watch case.

2. A band attachment mechanism according to claim 1, wherein the bond holding members are formed of a shock absorbing material.

3. A band attachment mechanism according to claim 2, wherein the shock absorbing material is synthetic resin.

4. A band attachment mechanism according to claim 1, wherein the pair of band holding members are attached to the pair of band attachment portions of the watch case to extend obliquely and outwardly from the back surface of the watch case.

5. A band attachment mechanism according to claim 1, wherein each of the pair of band holding members has an abutment tab which abuts the back surface of the watch case while the band holding members are attached to the band attachment portions of the watch case.

6. A band attachment mechanism according to claim 1, wherein an opening is formed in each of the band holding members at a position near to the extending end of each of the band holding members.

7. A band attachment mechanism according to claim 1, further comprising a pair of band pieces which are detachably attached to the band attachment portions of the watch case in place of the pair of band holding members and the watch band consisting of one band piece.

* * * * *